United States Patent [19]

Martello et al.

[11] Patent Number: 4,584,847

[45] Date of Patent: Apr. 29, 1986

[54] INSTANT COOLING DEVICE FOR COSMETICS

[76] Inventors: Rita A. Martello, 52 Tomkins Ave., Stony Point, N.Y. 10980; Endre L. Berecz, 1701 SW. 22 Ave., Ft. Lauderdale, Fla. 33312

[21] Appl. No.: 647,356

[22] Filed: Sep. 4, 1984

[51] Int. Cl.[4] ..... F25D 3/00

[52] U.S. Cl. ..... 62/293; 62/371; 62/457; 222/501; 251/75; 251/297

[58] Field of Search ..... 62/293, 371, 514 R, 62/64, 457; 251/75, 297; 222/501, 402.1, 402.25

[56] References Cited

U.S. PATENT DOCUMENTS

| | | | |
|---|---|---|---|
| 1,897,723 | 2/1933 | Free | 62/457 X |
| 2,685,978 | 8/1954 | Crockett | 222/402.25 X |
| 2,751,128 | 6/1956 | Prince | 222/501 X |
| 2,805,556 | 9/1957 | Wang | 62/457 X |
| 3,128,915 | 4/1964 | Matter | 222/501 X |
| 3,373,579 | 3/1968 | Federighi | 62/64 X |
| 3,987,643 | 10/1976 | Willis | 62/371 |
| 4,361,013 | 11/1982 | Skeele | 62/514 R X |

*Primary Examiner*—William E. Tapolcai

[57] ABSTRACT

A new instant cooling device for cosmetics is disclosed. Unique light weight and small refrigerator system is used in combination with a safety device to reinstate the proper hardness and consistency of facial cosmetics by cooling.

The instant cooling device comprises pressure vessel with valve containing liquid refrigerant and adequate release mechanism to allow efficient cooling of personal size cosmetics.

11 Claims, 2 Drawing Figures

INSTANT COOLING DEVICE FOR COSMETICS

BACKGROUND OF THE INVENTION

1. Field of the Invention

This invention relates to the field of cosmetics and specifically to create means to preserve or reinstate the quality or consistency of the cosmetics.

2. Description of the Prior Art

In the past efforts were made to formulate certain cosmetics to withstand a wide temperature range without changing their consistency. It was difficult if not impossible to assure the desirable consistency or hardness at extremely high temperatures. As the result the majority of cosmetics, such as lipsticks, eyeshadows and other facial makeups became very soft and unmanageable at elevated temperatures. Short of refrigerating the cosmetics there was little or no solution to overcome this problem.

The present invention employs effective cooling means able to restore the desired consistency of the mentioned cosmetics just before each application.

SUMMARY OF THE INVENTION

The inventive cooling device for cosmetics is adapted to the container of the cosmetic substance.

In one embodiment, the cap portion of a lipstick is altered to contain a pressure vessel filled with liquid refrigerant media. The open end of the pressure vessel is sealed with a valve, a conveniently located pushbutton, when depressed will release a small portion of the refrigerant through the valve, allowing the expanded gases to cool the exposed surface area of the lipstick. The duration of the flow is automatically limited by mechanical means in order to conserve the refrigerant supply.

As a safety measure, in order to eliminate the danger of refrigerant burns, a set of properly biased leaf springs will prevent activating the device in the case the cap is removed. However, when the cap is replaced, singular or repetitive application of the refrigerant is possible.

BRIEF DESCRIPTION OF THE DRAWINGS

Various other objects, adventages, and features of the invention will become apparent to those skilled in the art. The following discussion taken in conjunction with the subsequent drawings shows.

DESCRIPTION OF THE PREFERRED EMBODIMENT

Figure 1:
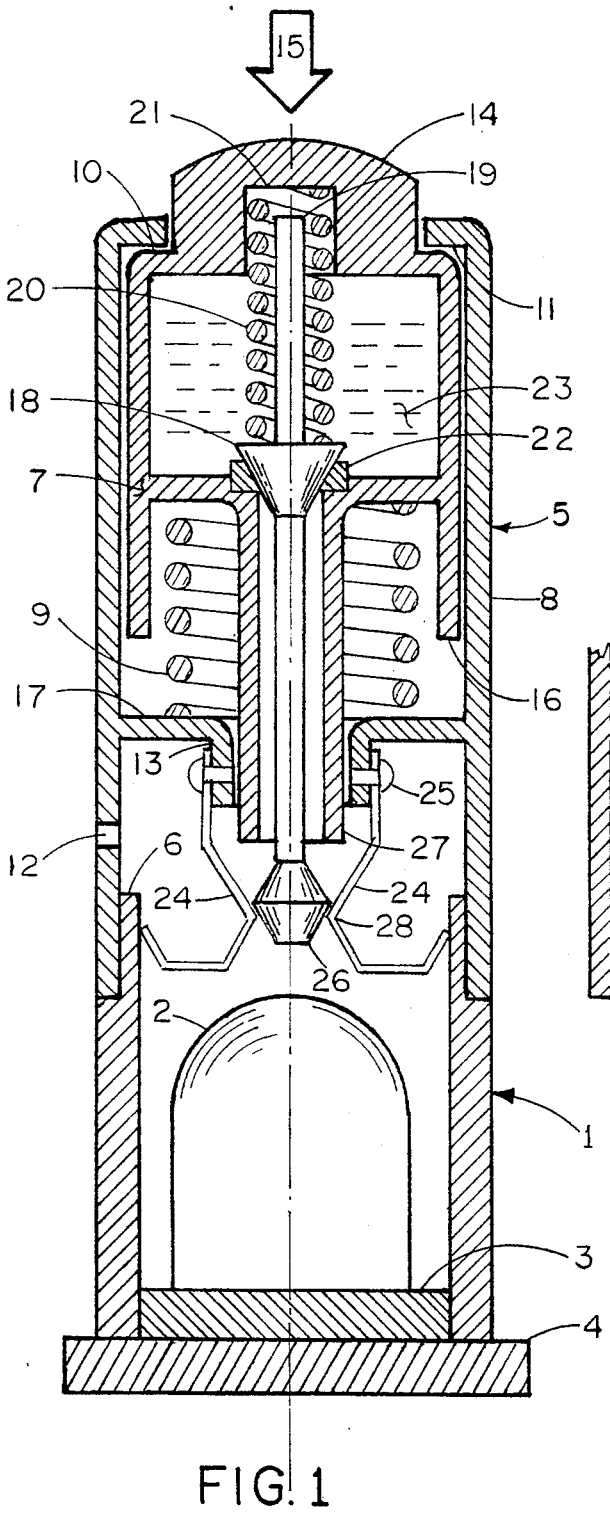
FIG. 1 as a cross-sectional view of one embodiment of the present invention as applied to a lipstick container and FIG. 2 as a partial cross-sectional view taken of the lower portion of the cap after being removed from the container.
Figure 2:
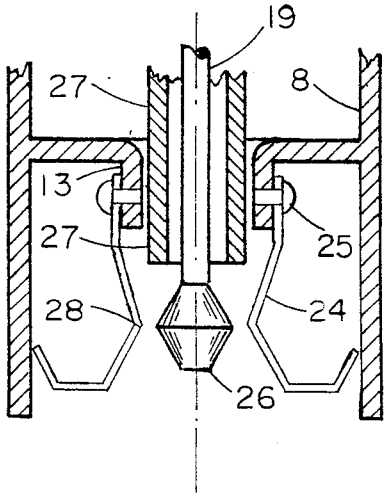

FIG. 1 shows one of the preferred embodiments of the instant cooling device for cosmetics, depicting a cross-sectional view of the device in conjunction lipstick 2, having a screw type extend-retract mechanism 3 shown without any details and is for referance only. Said mechanism 3 is activated by screw 4 serving also as a base for the container 1. The screw 4, while twisted will extend the lipstick 2 and the tip of the lipstick 2 will be raised above the top edge of the container 1. Also by twisting the screw 4 in the opposite direction it will retract the lipstick 2 into the container 1. FIG. 1 shows the lipstick 2 in the retracted position. The cap assembly 5 is firmly fitted to the container 1 by the spring backup sleeve 6. The pressure vessel 7 is loosley fitted into the cover sleeve 8 and it will also become a captive component part of the cap assembly 5. A return spring 9 is a compression spring which forces shoulder 10 of the pressure vessel 7 against the upper lip 11 of the cover sleeve 8. There is one or more relief holes 12 ventilating the inside area of the cap assembly 5 into the atmosphere. When finger pressure is exerted to the pushbutton tip 14 in the direction of the reference 15, it will displace the pressure vessel 7 downward until the lower stop 16 contacts the platform 17. The open end of the pressure vessel 7 is sealed by a valve 18. Said valve 18 is solidly attached to the vavle stem 19. The valve spring 20 is under compression and it is supported on the top end by the spring nest 21. The lower end of the valve spring 20 forces the valve 18 into the valve seat 22 thus firmly sealing the pressure vessel 7. The content of the pressure vessel 7 is a liquefied refrigerant 23 such as dichlorodifluoromethane or carbon dioxide. The leaf springs 24 are connected by fasteners 25 to the lower cylindrical extension 13 of the platform 17. A conical shaped dog 26 is firmly attached to the lower end of the valve stem 19. When the finger pressure is applied to the pushbutton tip 14 in the direction of the reference arrow, the spring forces of the leaf springs 24 acting upon the lower portion of the conical dog 26 will temporarely prevent the downward motion of the valve stem 19. As a result of this the valve 18 will separate from the valve seat 22 opposed only by the relatively small forces exerted by the valve spring 20. The liquid refrigerant 23 will now commence to flow freely trough the tubular channel 27. The liquid refrigerant 23 will expand rapidly to atmospheric pressure changes to gases whereby its temperature will decrease. The cold refrigerated gases will blow downward in the direction of the reference arrow 15 and will cool off the upper portion of the lipstick 2. The relief holes 12 will prevent excessive gas pressure buildup within the cap assembly 5. By continuous finger pressure to the pushbutton tip 14, the valve stem 20 will hit the spring nest 21 forcing the valve stem 19 and the attached conical dog 26 to move downward and forcefully pass through the leaf springs 24 by deflecting said leaf springs 24 outward. After the major diameter of the conical dog 26 passes through the knee 28 of the leaf springs 24, the valve spring 20 is unimpeded, subsequently it will shut the valve 18 off, thus stopping the flow of liquid refrigerant 23. When the finger pressure is continuously and evenly applied through its entire range of travel and the lower stop 16 rests on the platform 17, the valve 18 opens only for a very short period of time and as a result the flow of refrigerant 23 is only of a short duration. Releasing the pushbutton tip 14 and reapplying the finger pressure will release additional refrigerant 23 when needed. While releasing the pushbutton tip 14, the return spring 9 pushes the pressure vessel 7 back to the original starting position as shown on FIG. 1 while the valve 18 remains constantly in the closed position. The conical dog 26 will also return to its rest position. When the cap assembly 5 is removed from the container 1, the spring backup sleeve 6 lets the knees 28 of the leaf spring 24 separate from each other, thus the conical dog 26 may pass freely through the leaf springs 24. As the pushbutton tip 14 is depressed, the valve will remain closed since the leaf springs 24 are not engaged to the conical dog 26. This is a safety feature to avoid inadvertent activating of the device while the cap assembly 5 is removed. FIG. 2 is a partial cross-sectional view of the lower segment of the cap assembly 5, which will explain the mentioned safety feature and the relation of the leaf springs 24 and the conical dog 26 respectively.

While the invention has been described, disclosed, illustrated and shown in certain embodiments or modifications which it has assumed in practice, the scope of the invention is not intended to be nor should it be deemed to be limited thereby and such other modifications or embodiments as may suggested by the teachings herein are particularly reserved especially as they fall within the breadth and scope of the claims here appended

We claim:

1. A miniature cooling device adapted for cooling personal size facial cosmetics comprising cap assembly means attached to container means, said container means holding facial cosmetics, said cap assembly means having hollow bore therethrough;

pressure vessel means containing liquid refrigerant means, where said pressure vessel means being slidingly received within said bore of said assembly means;

valve means for sealing off said pressure vessel means, comprising a valve, valve seat means, a valve stem connected to said valve and valve stem means positioned around said valve stem;

leaf spring attached to said cap assembly means and conical dog means attached to said valve stem for preventing temporarely the relative motion of said valve stem means when said pressure vessel means is axially moved toward said container means.

2. The apparatus of claim 1, wherein said pressure vessel means having push button tip means allowing the application of external forces acting axially to said pressure vessel means and displacing said pressure vessel means trough a limited range of travel, also return spring means forcing a shoulder of said pressure vessel means against an upper lip of a cover sleeve means.

3. The apparatus of claim 2, wherein said pressure vessel means reaching its end of travel by contacting a lower stop means.

4. The apparatus of claim 3, wherein said valve stem means and conical dog means rigidly affixed to said valve means and said valve means separating from said valve seat means by said conical dog's motion being restrained by said leaf spring means, allowing liquid refrigerant to be released through a tubular channel.

5. The apparatus of claim 4, wherein said liquid refrigerant means expanding into a gaseous form when released to the atmosphere through said tubular channel and refrigerating said facial cosmetics opposed to the stream of said refrigerant means.

6. The apparatus of claim 3, wherein said valve stem means contacting spring nest means shortly before said pressure vessel means reaches the end of its range of travel and said conical dog means being forced through a knee of said leaf spring means to close said valve means.

7. The apparatus of claim 6, wherein said conical dog means being retracted by said return spring means into its original resting position in the absence of external forces.

8. The apparatus of claim 4, wherein said valve means remaining firmly closed during and after said conical dog means being retracted by said return spring means, stopping the flow of said liquid refrigerant means.

9. The apparatus of claim 4, wherein said leaf spring means are attached to cylindrical extension means being radially biased outward and by removing spring backup sleeve means, said leaf spring means now resting against the inside bore of said cover sleeve, causing an increase of the gap between the knees of a leaf springs, thus allowing said conical dog means to pass freely through the increased gap.

10. The apparatus of claim 9, wherein said valve means remaining permanently closed for safety reasons while said cap assembly being removed from said container means, regardless of the axial position of said pressure vessel means.

11. The apparatus of claim 1, wherein said cap assembly means of the cooling device may be adapted for cooling any other materials or media, other than cosmetics.

* * * * *